US009341976B2

(12) United States Patent
Hashii et al.

(10) Patent No.: US 9,341,976 B2
(45) Date of Patent: May 17, 2016

(54) MULTI-STATION IMAGE FORMING APPARATUS WITH START-UP CONTROL

(71) Applicant: CANON KABUSHIKI KAISHA, Tokyo (JP)

(72) Inventors: Hiroki Hashii, Yokohama (JP); Yuya Kojima, Kamakura (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 14 days.

(21) Appl. No.: 14/098,168

(22) Filed: Dec. 5, 2013

(65) Prior Publication Data

US 2014/0169816 A1 Jun. 19, 2014

(30) Foreign Application Priority Data

Dec. 13, 2012 (JP) ..... 2012-272402

(51) Int. Cl.
*G03G 15/043* (2006.01)
*G03G 15/16* (2006.01)

(52) U.S. Cl.
CPC ..... *G03G 15/043* (2013.01); *G03G 15/1675* (2013.01)

(58) Field of Classification Search
CPC ..... G03G 15/043; G03G 15/1675
USPC ..... 399/51, 66
See application file for complete search history.

(56) References Cited

U.S. PATENT DOCUMENTS

| | | | | |
|---|---|---|---|---|
| 2009/0135243 | A1* | 5/2009 | Yamazaki | |
| 2009/0214239 | A1* | 8/2009 | Horiuchi | 399/51 |
| 2011/0025811 | A1* | 2/2011 | Lee | |
| 2012/0099880 | A1 | 4/2012 | Inoue et al. | 399/66 |

FOREIGN PATENT DOCUMENTS

| | | |
|---|---|---|
| JP | 04-313776 | 11/1992 |
| JP | 2004-345171 | 12/2004 |
| JP | 2009-210986 | 9/2009 |
| JP | 2012-088553 | 5/2012 |

* cited by examiner

*Primary Examiner* — Walter L Lindsay, Jr.
*Assistant Examiner* — Milton Gonzalez
(74) *Attorney, Agent, or Firm* — Fitzpatrick, Cella, Harper & Scinto

(57) ABSTRACT

The apparatus includes a CPU which executes, based on a detection result of a BD sensor, start-up control for controlling driving of a scanner motor, so that a rotation number of the scanner motor reaches a predetermined rotation number, and executes determination control for determining a voltage to be applied to a primary transfer unit based on a detection result of a transfer current detection circuit by a transfer voltage output circuit upon execution of image formation, and when an image forming station K which executes image formation is different from an image forming station Y including the BD sensor, the CPU parallelly executes the start-up control and determination control.

15 Claims, 11 Drawing Sheets

MULTI-STATION IMAGE FORMING APPARATUS WITH START-UP CONTROL

BACKGROUND OF THE INVENTION

1. Field of the Invention

The present invention relates to an image forming apparatus such as a copying machine, printer, or facsimile of, for example, an electrophotography system or electrostatic recording system.

2. Description of the Related Art

Conventionally, a color image forming apparatus, which forms an image for one color by an image forming unit including a pair of laser scanners and an image bearing member, and includes image forming units as many as the number of colors, is known. In this arrangement, laser light beams, which are deflected and scanned by rotary polygon mirrors arranged for respective colors, are detected by laser detectors (to be referred to as Beam Detection (BD) sensors hereinafter) for respective colors, so as to generate horizontal sync signals (to be referred to as BD signals hereinafter) required to detect image write start timings of respective colors. Then, rotation cycles (to be referred to as BD cycles hereinafter) of scanner motors of respective colors are detected based on the BD signals. Also, emission (to be referred to as force emission hereinafter) of a semiconductor laser is performed until the BD cycles reach a predetermined value, and respective image bearing members are irradiated with laser light beams of respective colors reflected by the rotary polygon mirrors using a plurality of reflection surfaces.

Also, as a more inexpensive arrangement, a color image forming apparatus including one laser scanner and a plurality of image bearing members is known. In this arrangement, a single rotary polygon mirror, which is driven by a single scanner motor, is irradiated with laser light beams of respective colors, and the respective image bearing members are irradiated with the laser light beams using a plurality of reflection surfaces.

For example, Japanese Patent Application Laid-Open No. H04-313776 has proposed an arrangement in which a plurality of light sources is simultaneously scanned on a photosensitive member by different surfaces of a polygon mirror. Then, it proposes a unit which determines BD signals of respective colors of remaining light sources besides a light source provided with a BD sensor from a BD signal of the light source provided with the BD sensor and the rotation phase differences of the surfaces of the polygon mirror. For example, Japanese Patent Application Laid-Open No. 2004-345171 has proposed the following arrangement so as to solve color misregistration at transfer timings of respective colors caused by surface-division precisions of respective mirror surfaces of a rotary polygon mirror, which do not completely match. That is, this arrangement includes one BD sensor, which receives reflected laser light from the rotary polygon mirror, a BD signal output unit, which outputs a BD signal at a reception timing of the reflected laser light, and a pseudo BD sensor signal generation unit, which generates a pseudo BD sensor signal as a pseudo signal after an elapse of a predetermined period of time from the BD sensor. Then, a reference signal of a write start position in a main scanning direction of laser light with which a surface different from that irradiated with laser light, with which the BD sensor is irradiated, is irradiated with and reflected is defined by the pseudo BD sensor signal generation unit. Since Japanese Patent Application Laid-Open No. 2004-345171 includes such arrangement, misregistration at transfer timings of respective colors can be reduced even by one BD sensor.

In Japanese Patent Application Laid-Open No. H04-313776, the following control is executed. That is, during a period until a scanner motor is rotated at a stable speed (to be referred to as a scanner start-up period hereinafter), semiconductor lasers of respective colors emit laser light beams so as to detect a BD cycle and to calculate a rotation number of the scanner motor. Then, the semiconductor lasers of respective colors emit laser light beams, and light amount adjustment of the semiconductor lasers of respective colors is also executed at that timing. At this time, in a station in which force emission is performed, a photosensitive member surface is irradiated with laser light to change a potential of the photosensitive member surface. For this reason, control for determining a voltage required to supply a predetermined current to a transfer unit at an image formation timing (to be referred to as Active Transfer Voltage Control (ATVC) control hereinafter) cannot be executed during the scanner start-up period. As a result, a first print-out time (FPOT) from a print instruction until printing of the first page is completed cannot be shortened.

SUMMARY OF THE INVENTION

The present invention has been made in consideration of the above situation, and enables to shorten the FPOT.

In this context, the purpose of the present invention is to provide an image forming apparatus including a first image bearing member and a second image bearing member, on each of which an electrostatic latent image is formed by laser light, a first developing device and a second developing device, each configured to develop the electrostatic latent image formed on the corresponding image bearing member to form a toner image, a first transfer device and a second transfer device, each configured to transfer the toner image on the corresponding image bearing member onto a recording medium, an application unit configured to apply a voltage to the second transfer device; a current detection unit configured to detect a current flowing when the application unit applies the voltage to the second transfer device, a first light source and a second light source, each configured to emit laser light to the corresponding image bearing member, a rotary polygon mirror configured to deflect the laser light beams emitted from the first light source and the second light source, a motor configured to drive the rotary polygon mirror, a detection unit configured to detect the laser light deflected by the rotary polygon mirror, and a control unit configured to execute, based on a detection result of the detection unit, start-up control for controlling driving of the motor so that a rotation number of the motor reaches a predetermined rotation number, and determination control for determining a voltage to be applied from the application unit to the second transfer device upon execution of image formation, wherein the detection unit is arranged at a position where the detection unit detects the laser light deflected by the rotary polygon mirror toward the first image bearing member, and the control unit executes the start-up control and the determination control in parallel.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

First Embodiment

With the arrangement of the first embodiment, when a BD station and image forming station are different upon execution of a monochrome mode, ATVC control of the image forming station is executed without waiting until a scanner motor is stably rotated at a target speed. That is, when the BD station is different from the image forming station which executes the mode, force emission of the image forming station is skipped at a scanner start-up timing, and ATVC control is executed in the image forming station parallel to the scanner start-up. Note that the BD station is an image forming station of a color including a BD sensor as a laser detector. Also, the ATVC control is determination control for determining a voltage required to supply an appropriate current to a transfer unit at an image formation timing.

Configuration of Image Forming Apparatus

Figure 1A:
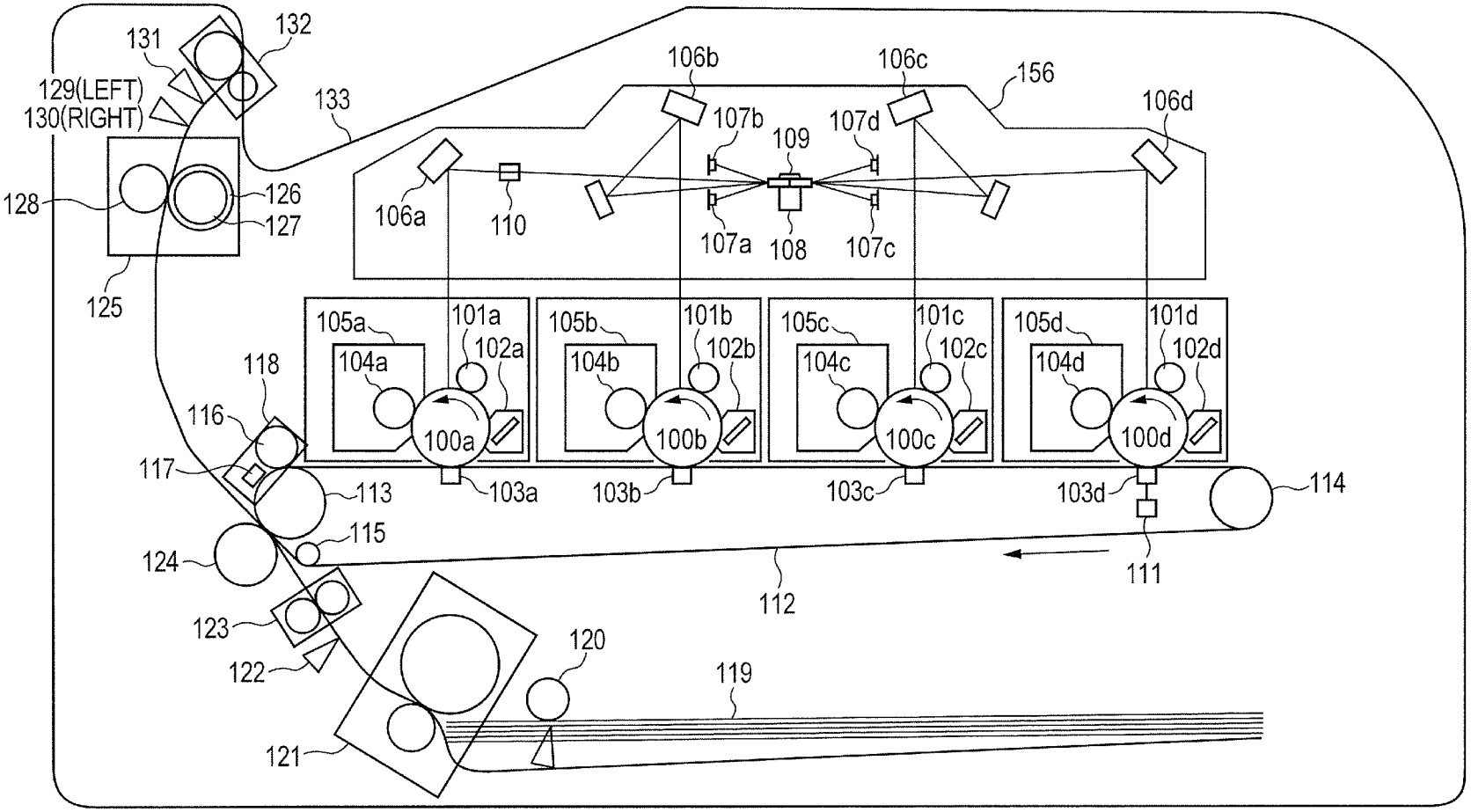
FIG. 1A is a schematic view showing the overall arrangement of an image forming apparatus according to the first embodiment.

FIG. 1A is a view for explaining the overall arrangement of an image forming apparatus according to this embodiment. The image forming apparatus of this embodiment includes four electrophotographic photosensitive members (to be referred to as photosensitive drums hereinafter) 100*a*, 100*b*, 100*c*, and 100*d* as juxtaposed image bearing members. Note that this embodiment includes the four photosensitive drums 100*a*, 100*b*, 100*c*, and 100*d* for yellow (to be abbreviated as Y hereinafter), magenta (to be abbreviated as M hereinafter), cyan (to be abbreviated as C hereinafter), and black (to be abbreviated as K hereinafter). Note that suffices a, b, c, and d represent yellow, magenta, cyan, and black, and will be omitted except for required cases. Each photosensitive drum 100 is rotated in a counterclockwise direction, as indicated by an arrow in FIG. 1A. Around each photosensitive drum 100, a charging roller 101, cleaning device 102, primary transfer unit 103, and developing unit 105 are arranged to form each of a plurality of image forming stations of respective colors.

As an exposure unit which exposes each photosensitive drum 100, a scanner unit 156 is arranged. The scanner unit 156 includes semiconductor lasers 107 as light sources, and a rotary polygon mirror 109 connected to a scanner motor 108. In this manner, this embodiment adopts an arrangement in which laser light beams emitted from the four semiconductor lasers 107*a*, 107*b*, 107*c*, and 107*d* are deflected by one rotary polygon mirror 109. Laser light emitted from each semiconductor laser 107 is reflected and deflected by the rotary polygon mirror 109 rotated by the scanner motor 108, and a surface of the corresponding photosensitive drum 100 is irradiated with that laser light by a corresponding reflection mirror 106. Note that the scanner unit 156 includes the semiconductor lasers 107, scanner motor 108, rotary polygon mirror 109, reflection mirrors 106, and a BD sensor 110 as a laser detector.

The charging roller 101 uniformly charges the surface of each photosensitive drum 100. When the surface of the photosensitive drum 100, which is uniformly charged by the charging roller 101, is irradiated with laser light reflected by the reflection mirror 106, an electrostatic latent image is formed on the photosensitive drum 100. The BD sensor 110 as a laser detector receives laser light, and generates a BD signal. The BD sensor 110 is arranged on a scanning line of the laser beam. The BD sensor 110 is arranged on an optical path of laser light which is reflected by the rotary polygon mirror 109 and with which the reflection mirror 106*a* is irradiated. In this embodiment, since a yellow image forming station (to be referred to as an image forming station Y hereinafter; the same applies to the remaining colors) includes the BD sensor 110, the image forming station Y will also be referred to as a BD station Y hereinafter. A rotation number of the scanner motor 108 is calculated from a cycle of the BD signal generated by the BD sensor 110.

The developing unit 105 applies toner (developing agent) of each color on the surface of the photosensitive drum 100 on which an electrostatic latent image is formed by a developing roller 104, thereby visualizing the electrostatic latent image as a toner image. The cleaning device 102 removes residual toner on the surface of the photosensitive drum 100 after transfer. At a position opposing the photosensitive drums 100, an intermediate transfer belt 112 as an intermediate transfer member is extended between a driving roller 113, tension roller 114, and driven roller 115. The intermediate transfer belt 112 pivots in a clockwise direction, as indicated by an arrow in FIG. 1A, and toner images formed on the surfaces of the photosensitive drums 100 are transferred (primary transfer). On the intermediate transfer belt 112, an ICL roller 116 and ICL brush 117 (to be referred to as an ICL 118 in combination hereinafter), which serve as a toner charging member used to charge toner attached on the intermediate transfer belt 112, are arranged. The ICL 118 charges residual toner (to be referred to as secondary transfer residual toner hereinafter) on the intermediate transfer belt 112 after transfer. Then, the charged secondary transfer residual toner moves to the image forming station while being placed on the intermediate transfer belt 112, is inversely transferred onto the photosensitive drum 100, and is recovered by the cleaning unit 102.

At a position opposing the driving roller 113 behind the intermediate transfer belt 112, a driven secondary transfer roller 124 is arranged. Toner images formed on the photosensitive drums 100 are primarily transferred onto the intermediate transfer belt 112 upon operations of the primary transfer units 103. The primary transfer unit 103*d* includes a transfer current detection circuit 111, which measures a current value according to a voltage applied to each primary transfer unit 103. Note that the image forming station Y, image forming station M, image forming station C, and image forming station K are arranged in turn from the upstream side toward the downstream side of a conveyance direction (pivot direction) of the intermediate transfer belt 112. The transfer current detection circuit 111 is required for the ATVC control as control for determining a transfer voltage, as will be described later. In this embodiment, the transfer current detection circuit 111 is arranged in the image forming station K as a most-downstream side image forming station.

On the other hand, a recording material 119 picked up by a pickup roller 120 from a paper cassette is separated and fed one by one by a separation unit (not shown). Next, the recording material 119 fed from a conveyance roller pair 121 turns on a registration sensor 122, and is conveyed to a position between the driving roller 113 and secondary transfer roller 124 at a predetermined timing by a registration roller pair 123. Toner images on the intermediate transfer belt 112 are transferred onto the recording material 119 by the secondary transfer roller 124, and are fixed by a fixing unit 125. The fixing unit 125 includes a fixing roller 127, a surface layer of which is covered by a fixing film 126, and a pressure roller 128, and the fixing roller 127 and pressure roller 128 are in contact with each other. After the toner images are fixed, a paper width of the recording material 119 is detected by paper width sensors 129 (on the left side in the conveyance direction of the recording material 119) and 130 (on the right side). After that, the recording material 119 turns on a fixing/exhaust sensor 131, is conveyed by an exhaust roller pair 132, and is then exhausted onto an exhaust tray 133 arranged on an upper portion of the image forming apparatus main body.

System Configuration of Image Forming Apparatus

Figure 1B:
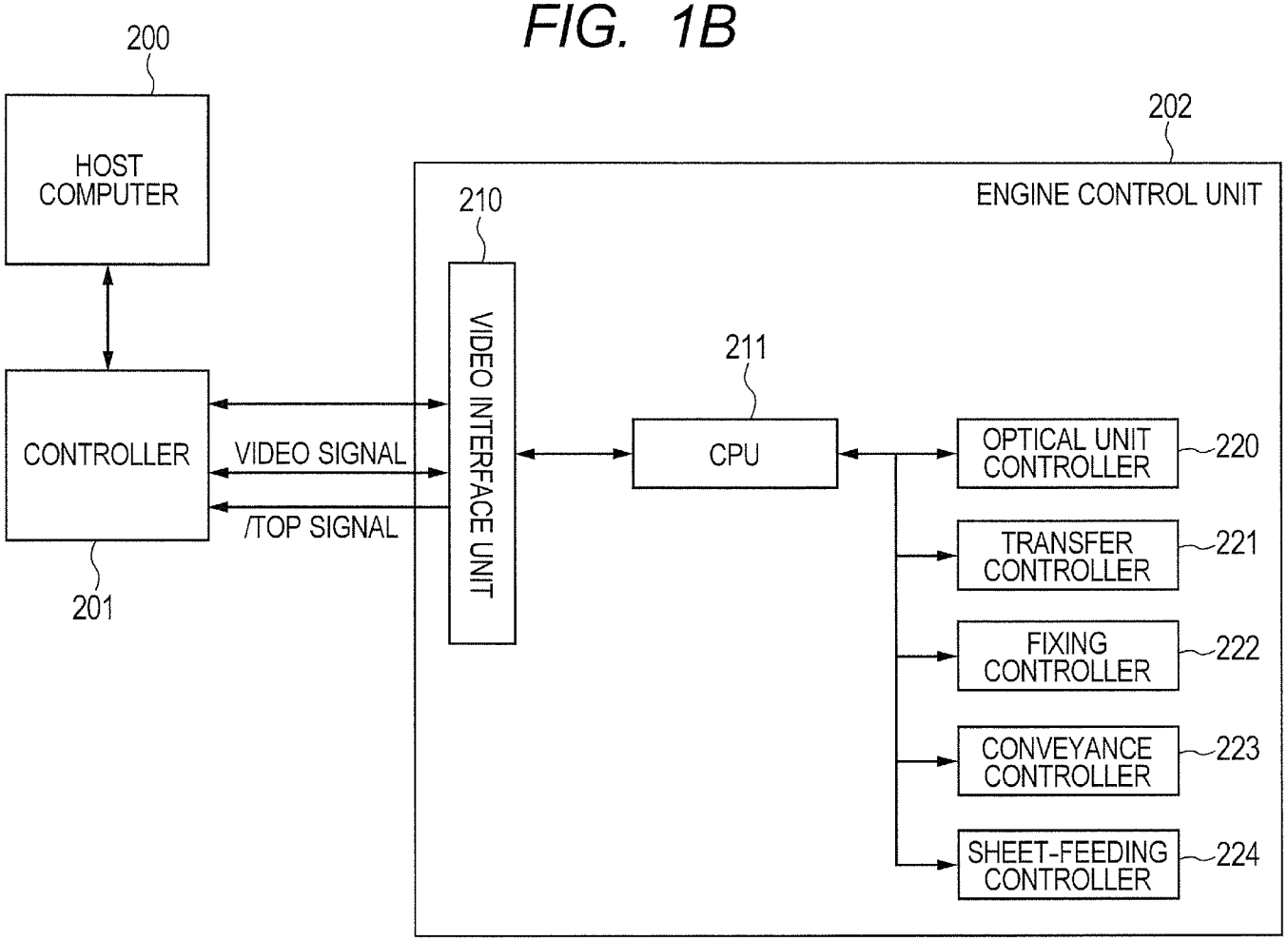
FIG. 1B is a block diagram showing the system arrangement of the image forming apparatus.

FIG. 1B is a block diagram for explaining the system arrangement of the image forming apparatus. A controller 201 can mutually communicate with a host computer 200 and engine control unit 202. The controller 201 receives image information and a print instruction from the host computer 200. Then, the controller 201 analyzes the received image information to convert it into bit data, and transmits a print reservation command, print start command, and video signal for each recording material to the engine control unit 202 via a video interface 210. The controller 201 transmits a print reservation command to the engine control unit 202 according to a print instruction from the host computer 200, and transmits a print start command to the engine control unit 202 at a timing of a ready-to-print state. Upon reception of the print instruction from the controller 201, the engine control unit 202 outputs a /TOP signal as an output reference timing of a video signal to the controller 201, thus starting a print operation. The engine control unit 202, which started the print operation, controls an optical unit controller 220, transfer controller 221, fixing controller 222, conveyance controller 223, sheet-feeding controller 224 using a CPU 211, thus executing image forming operations required for the print operation.

Configuration of Engine Control Unit and Respective Controllers

Figure 2:
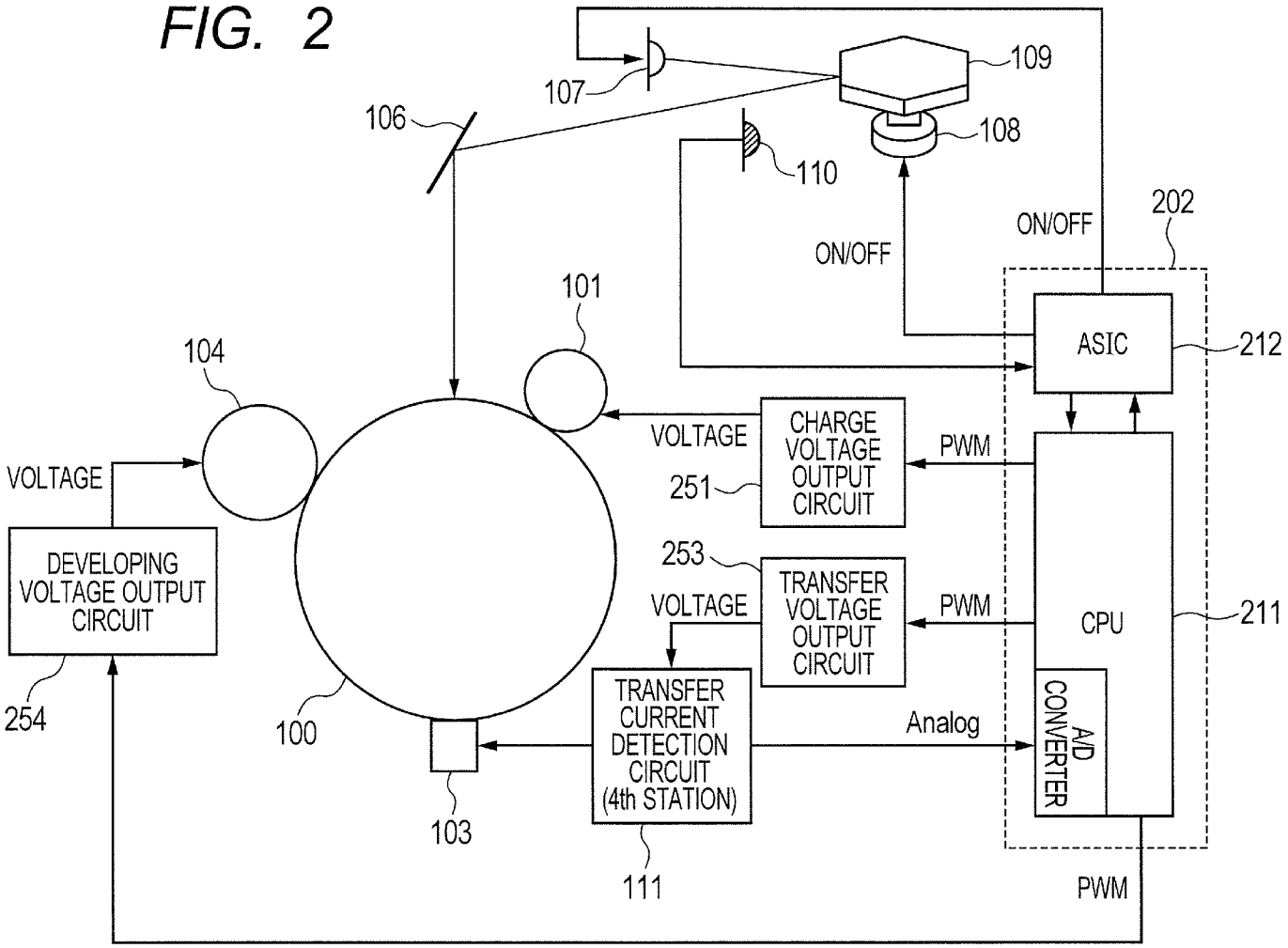
FIG. 2 is a diagram showing the arrangement of an engine control unit and respective controllers according to the first embodiment.

FIG. 2 is a diagram showing the arrangement of the engine control unit 202 (broken line part) and respective controllers of this embodiment. The CPU 211 in the engine control unit 202 outputs a PWM signal to high-voltage output circuits of the charging roller 101, primary transfer unit 103, and developing roller 104. More specifically, the CPU 211 outputs a PWM signal to a charge voltage output circuit 251, transfer voltage output circuit 253, and developing voltage output circuit 254. The charge voltage output circuit 251, transfer voltage output circuit 253, and developing voltage output circuit 254 respectively output voltages to the charging roller 101, primary transfer unit 103, and developing roller 104. Note that the charge voltage output circuit 251, transfer voltage output circuit 253, and developing voltage output circuit 254 apply high voltages according to the PWM signal input from the CPU 211 by boosters in the respective high-voltage output circuits to respective high-voltage output units. Note that when a duty ratio of the PWM signal output from the CPU 211 is changed, high voltages applied to the respective high-voltage output units are changed.

To the transfer voltage output circuit 253, the transfer current detection circuit 111 is connected. The transfer current detection circuit 111 detects a current flowing through the primary transfer unit 103, and inputs an analog signal corresponding to the current value to the CPU 211. Note that "$4^{th}$ station" in FIG. 2 implies that the transfer current detection circuit 111 is connected to the fourth image forming station. As described above using FIG. 1A, the transfer current detection circuit 111 is connected to the black image forming station K as the fourth image forming station, and detects a current flowing through the primary transfer unit 103. An analog signal (described as "Analog" in FIG. 2) corresponding to the current value detected by the transfer current detection circuit 111 is input to the CPU 211 in the engine control unit 202, and is converted into a digital value by an A/D converter in the CPU 211. The CPU 211 can detect the current value flowing through the primary transfer unit 103 based on the digital value obtained by converting the analog signal input from the transfer current detection circuit 111 by the A/D converter. An ASIC 212 in the engine control unit 202 executes rotation control of the scanner motor 108 and ON/OFF ("ON/OFF" in FIG. 2) of the semiconductor laser 107.

The CPU 211 can set a light-on method of the semiconductor laser 107 in the ASIC 212. Note that the light-on method of the semiconductor laser 107 which can be set by the CPU 211 in the ASIC 212 includes, for example, light-off, force emission, and unblanking emission. Note that unblanking emission is a light-on method of turning on laser light only in the vicinity of the BD sensor 110, that is, in only a non-image area of the photosensitive drum 100. When the BD sensor 110 receives laser light of the semiconductor laser 107, it outputs a BD signal to the engine control unit 202. The engine control unit 202 outputs the BD signal to the controller 201, which outputs a video signal to the engine control unit 202 in synchronism with the BD signal.

Control of Comparative Example

Figure 3:
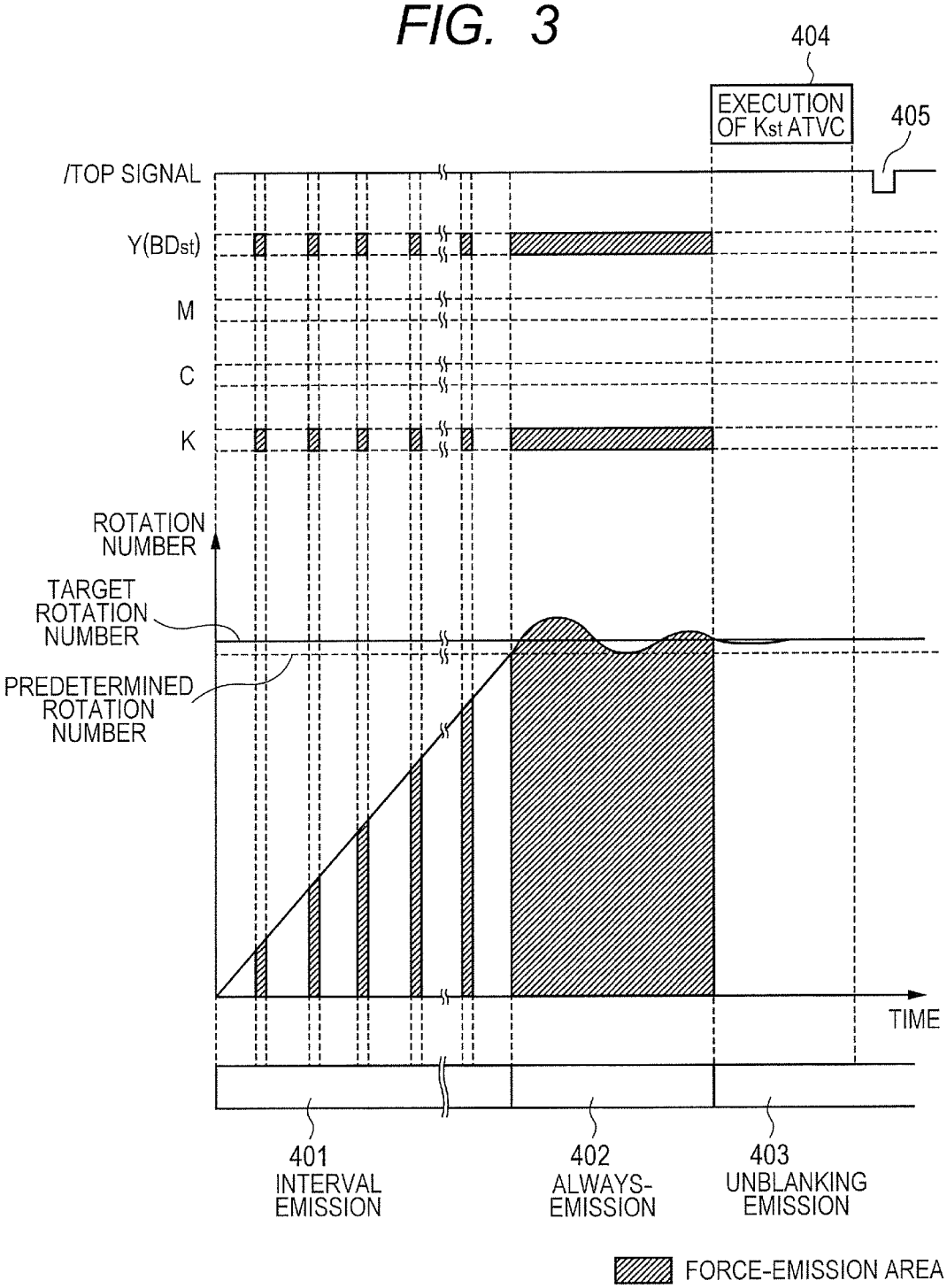
FIG. 3 is a chart showing scanner start-up and laser emission timings in a monochrome mode of a comparative example to be compared with the first embodiment.

FIG. 3 is a chart showing scanner start-up and laser emission timings in a monochrome mode of a comparative example to be compared with this embodiment. Note that in the monochrome mode, the black image forming station K alone performs image formation, and the remaining image forming stations Y, M, and C do not perform image formation. FIG. 3 shows, in turn from the top, a waveform of a /TOP signal output from the engine control unit 202 to the controller 201, emission states of the respective semiconductor lasers 107 in the four image forming stations, a rotation number of the scanner motor 108, and a lighting state of the semiconductor laser 107. Note that the image forming station Y of the four image forming stations is the BD station (described as "BDst"), and the image forming station K performs an image forming operation by emitting laser light so as to execute the monochrome mode. As for the emission states of the respective semiconductor lasers 107, a force-emission period (force-emission area) of the semiconductor laser 107 is indicated by hatching.

The CPU 211 sets a target rotation number (indicated by a solid line in FIG. 3) of the scanner motor 108 in the ASIC 212 and starts rotation driving of the scanner motor 108 via the ASIC 212. The CPU 211 executes start-up control via the ASIC 212 so that the rotation number of the scanner motor 108 reaches the target rotation number. Also, the CPU 211 controls the BD station Y and image forming station K to repeat ON/OFF of laser light beams at predetermined intervals via the ASIC 212 during the start-up control of the scanner motor 108 (zone 401: interval emission). Note that an emission mode of the semiconductor laser 107 which repeats ON/OFF of laser light will be referred to as interval emission hereinafter. In the interval emission, laser light is emitted even on an image area of the photosensitive drum 100 unlike in the unblanking emission. During the interval emission zone 401, the CPU 211 detects a rotation cycle of the rotary polygon mirror 109 based on a BD signal output from the BD sensor 110 arranged in the BD station Y, and calculates a rotation number of the scanner motor 108. During the zone 401, the CPU 211 executes light amount adjustment of the semiconductor laser 107*d* in the image forming station K used to perform image formation.

As described above, in the comparative example, during the interval emission zone 401, the rotation number of the scanner motor 108 is detected by the interval emission of the semiconductor laser 107*a*, and the light amount adjustment of the semiconductor laser 107*d* is executed by the interval emission of the semiconductor laser 107*d*.

The CPU 211 repetitively executes the interval emission of the semiconductor laser 107*a* during the zone 401 to judge whether or not the rotation number of the scanner motor 108 has reached a predetermined rotation number. If the CPU 211 detects that the rotation number of the scanner motor 108 has reached the predetermined rotation number, and the rotation speed has reached a predetermined rotation speed, it controls the semiconductor lasers 107*a* and 107*d* to always emit light via the ASIC 212 (zone 402). The ASIC 212 accelerates or decelerates the scanner motor 108 so as to control the rotation number of the scanner motor 108 to reach the target rotation number set by the CPU 211. If the CPU 211 judges that the rotation number of the scanner motor 108, that is, the rotary polygon mirror 109 has reached the target rotation number, it controls the ASIC 212 to execute unblanking emission, in which the semiconductor laser is turned on only in the vicinity of the BD sensor 110 (zone 403). In this embodiment, since the BD sensor 110 is arranged in the image forming station Y, the semiconductor laser 107*a* executes unblanking emission. Then, the CPU 211 executes the ATVC control required to determine a transfer voltage of the image forming station K (described as "Kst" in FIG. 3) at the start timing of the unblanking emission (described as "execution of KstATVC" in FIG. 3 (zone 404)). Upon completion of the ATVC control, the CPU 211 permits the ASIC 212 to output a /TOP signal, and the /TOP signal is output from the engine control unit 202 to the controller 201 (timing 405), thus starting image formation.

Control in Monochrome Mode of Comparative Example

Figure 4:
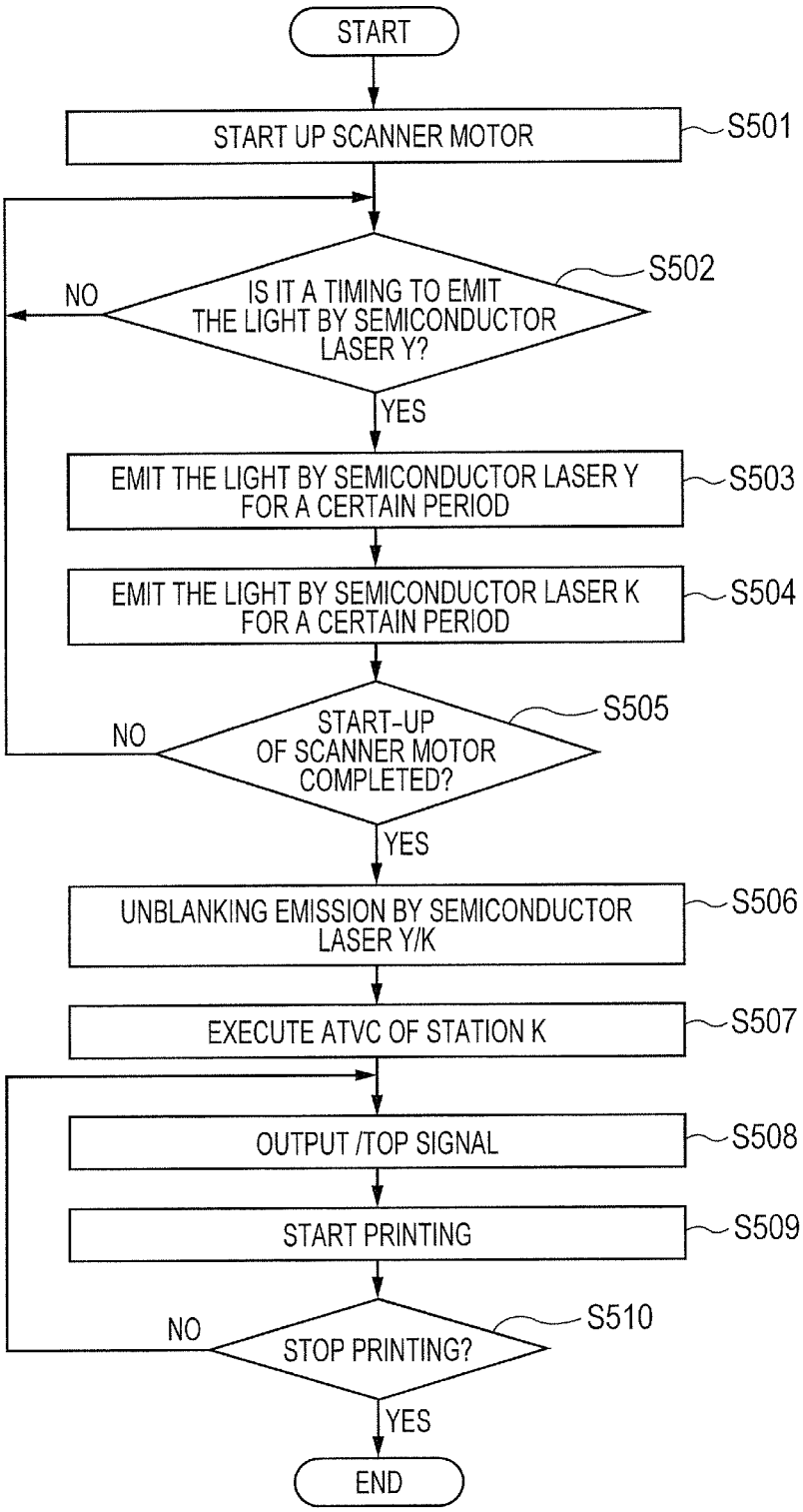
FIG. 4 is a flowchart for explaining scanner start-up in the monochrome mode of the comparative example to be compared with the first embodiment.

FIG. 4 is a flowchart for explaining scanner start-up in the monochrome mode of the comparative example to be compared with this embodiment. In step (to be abbreviated as "S" hereinafter) 501 in FIG. 4, upon reception of a monochrome mode instruction from the controller 201, the CPU 211 starts to drive (start up) the scanner motor 108 via the ASIC 212. In S502, the CPU 211 judges whether or not a timing to emit light (to be referred to as an emission timing hereinafter) by the semiconductor laser 107*a* (described as "semiconductor laser Y" in FIG. 4; the same applies to the following description) is reached. Note that the CPU 211 judges the emission timing of the semiconductor laser 107*a* when the rotation acceleration of the scanner motor 108 is stabilized (for example, about 200 ms). If the CPU 211 judges in S502 that the emission timing of the semiconductor laser 107*a* is not reached, the process returns to S502.

If the CPU 211 judges in S502 that the emission timing of the semiconductor laser 107*a* is reached, it controls the semiconductor laser 107*a* to emit light for a certain period in S503, and the process advances to S504. In S504, the CPU 211 controls the semiconductor laser 107*d* (described as "semiconductor K" in FIG. 4; the same applies to the following description) to emit light for a certain period, thus executing the light amount adjustment of the semiconductor laser 107*d*. As described above, the semiconductor laser 107*a* emits light to detect the rotation number of the scanner motor 108, while the semiconductor laser 107*d* emits light to execute the light amount detection. Therefore, the certain periods required to emit light by the semiconductor lasers 107*a* and 107*d* can be emission time periods required to achieve their aims. Furthermore, during the zone 401 in FIG. 3, the semiconductor lasers 107*a* and 107*d* are controlled to emit light for the same time period (zones (time periods) of force emission areas are equal to each other). However, a time period required to control the semiconductor laser 107*a* to emit light and that required to control the semiconductor laser 107*d* to emit light may be different time periods since their aims need only be achieved. Note that the processes of S501 to S504 correspond to those of the interval emission zone 401 described in FIG. 3.

The CPU 211 judges in S505 whether or not start-up of the scanner motor 108 is completed. If the CPU 211 judges in S505 that start-up of the scanner motor 108 is not completed, the process returns to S502. If the CPU 211 judges in S505 that start-up of the scanner motor 108 is completed, it controls the semiconductor lasers 107*a* and 107*d* (described as "semiconductor laser Y/K" in FIG. 4; the same applies to the following description) to make unblanking emission via the ASIC 212 in S506. In S507, the CPU 211 executes the ATVC control of the image forming station K. Note that an interval in which judgment of S505 is made corresponds to the always-emission zone 402 in FIG. 3, and the processes of S506 and S507 correspond to those of the zones 403 and 404 described in FIG. 3.

Upon completion of the processing of the ATVC control of the image forming station K, the CPU 211 outputs a /TOP signal to the controller 201 in S508, thus starting a printing operation in S509. Note that the process of S508 corresponds to the timing 405 described in FIG. 3. The CPU 211 judges in S510 whether or not the printing operation ends. If the CPU 211 judges that the printing operation does not end, the process returns to S508; otherwise, it ends the overall processing.

ATVC Control

Figure 5A:
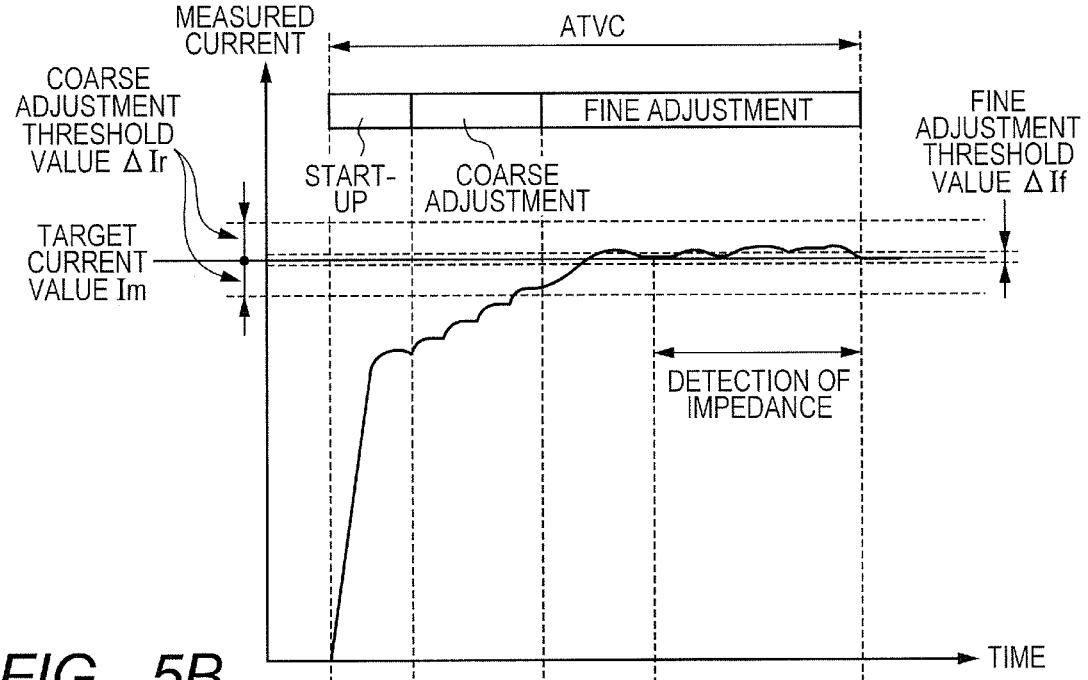
FIGS. 5A and 5B are sequence charts showing ATVC control of the first and second embodiments.
Figure 5B:
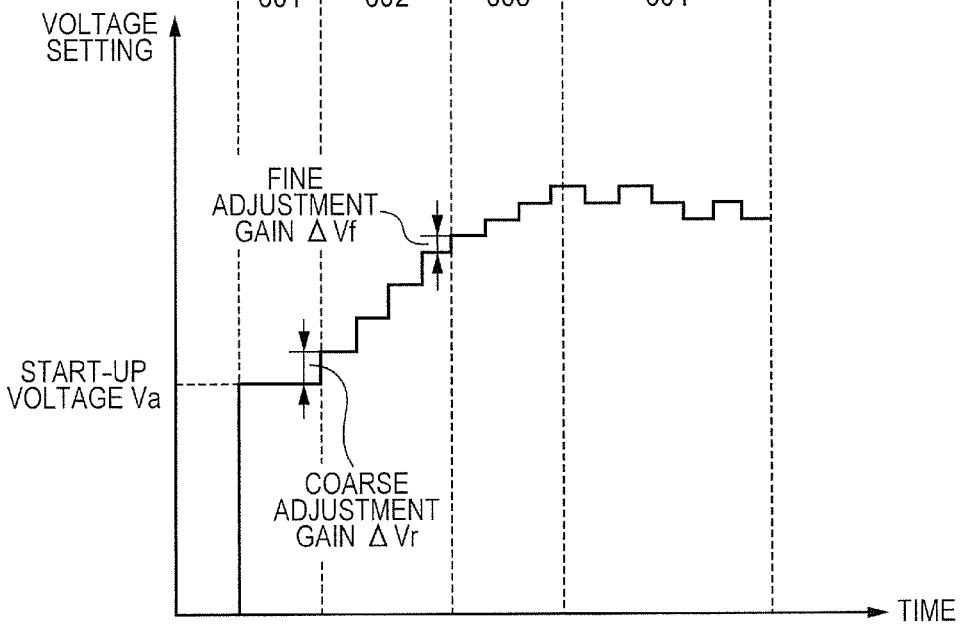

FIGS. 5A and 5B are views for explaining the ATVC control. The ATVC control is control for determining a voltage to be applied to the primary transfer unit 103 based on a measured result of the transfer current detection circuit 111, so that a predetermined target current value Im flows.

FIG. 5A is a graph showing a temporal change in current (to be referred to as a measured current hereinafter) I measured by the transfer current detection circuit 111, and FIG. 5B is a graph showing a temporal change in setting value (to be referred to as a voltage setting hereinafter) of a voltage to be applied to the primary transfer unit 103. In FIGS. 5A and 5B, the horizontal axis represents a time.

As described above, the CPU 211 controls the semiconductor laser 107 to make unblanking emission to start execution of the ATVC control. Simultaneously with the beginning of execution of the ATVC control, the CPU 211 controls the transfer voltage output circuit 253 to apply a predetermined start-up voltage Va to the primary transfer unit 103, and controls the transfer current detection circuit 111 to measure a current value I flowing through the primary transfer unit 103 (zone 601). At this time, the CPU 211 judges whether or not the current value (to be referred to as a measured current value hereinafter) I measured by the transfer current detection circuit 111 falls within a range of a coarse adjustment threshold value ΔIr with reference to a target current value Im (to check if Im−ΔIr≤I≤Im+ΔIr is satisfied). Then, if the CPU 211 judges that the measured current value I falls outside the range of the coarse adjustment threshold value ΔIr, it adds a coarse adjustment gain ΔVr to a voltage Vn currently applied to the primary transfer unit 103. Note that an initial value of Vn is a predetermined start-up voltage Va (=V1 (n=1)).

$$V=Vn+\Delta Vr \tag{1}$$

The CPU 211 controls the transfer voltage output circuit 253 to apply the voltage V given by equation (1) to the primary transfer unit 103, controls the transfer current detection circuit 111 to measure the current value I, and judges whether or not the measured current value I falls within the range of the coarse adjustment threshold value ΔIr with reference to the target current value Im. The CPU 211 repeats this control (to be referred to as coarse adjustment control hereinafter) until the measured current value I falls within the range of the coarse adjustment threshold value ΔIr of the target current value Im (zone 602).

After the aforementioned coarse adjustment control is repeated, when the CPU 211 judges that the measured current value I measured by the transfer current detection circuit 111 falls within the range of the coarse adjustment threshold value ΔIr of the target current value Im, it adjusts the current value I using a fine adjustment gain ΔVf which satisfies ΔVr>ΔVf. When the CPU 211 judges that the measured current value I measured by the transfer current detection circuit 111 is smaller than the target current value Im, it adds the fine adjustment gain ΔVf to the voltage Vn currently applied to the primary transfer unit 103.

$$V=Vn+\Delta Vf \tag{2}$$

On the other hand, when the CPU 211 judges that the measured current value I measured by the transfer current detection circuit 111 is larger than the target current value Im, it subtracts the fine adjustment gain ΔVf from the voltage Vn currently applied to the primary transfer unit 103.

$$V=Vn-\Delta Vf \tag{3}$$

After that, the CPU 211 repeats the control of equation (2) or (3) (to be referred to as fine adjustment control hereinafter) until it judges that the measured current value I measured by the transfer current detection circuit 111 falls (converges) within a range of a fine adjustment threshold value ΔIf of the target current value Im (zone 603). Note that the CPU 211 judges that the measured current value I converges within the range of the fine adjustment threshold value ΔIf when it satisfies Im−ΔIf/2≤I≤Im+ΔIf/2.

When the CPU 211 judges that the measured current value I measured by the transfer current detection circuit 111 falls within the range of the fine adjustment threshold value ΔIf of the target current value Im, it detects an impedance (zone 604). The CPU 211 determines a voltage required to supply the target current value Im to the primary transfer unit 103 during an image forming operation based on the detected impedance. During the image forming operation, constant voltage control is executed so that the voltage determined by the ATVC control is a constant voltage. Alternatively, constant current control for changing a voltage value by the CPU 211 based on the measured current value I so as to maintain the target current value Im even during the image forming operation may be executed.

Note that the ATVC control detects a current flowing through the primary transfer unit 103 by the transfer current detection circuit 111 so as to detect impedance. When the semiconductor laser 107 is controlled to emit light to irradiate the photosensitive drum 100 with laser light while the transfer current detection circuit 111 detects a current, the surface potential of the photosensitive drum 100 changes, and a correct current value cannot be detected. For this reason, in the control of the comparative example, the ATVC control is not executed during the interval emission zone 401 for executing the light amount adjustment of the semiconductor laser 107*d* or the always-emission zone 402, but is executed during the unblanking emission zone 403 (see FIG. 3).

Control of this Embodiment

Figure 6:
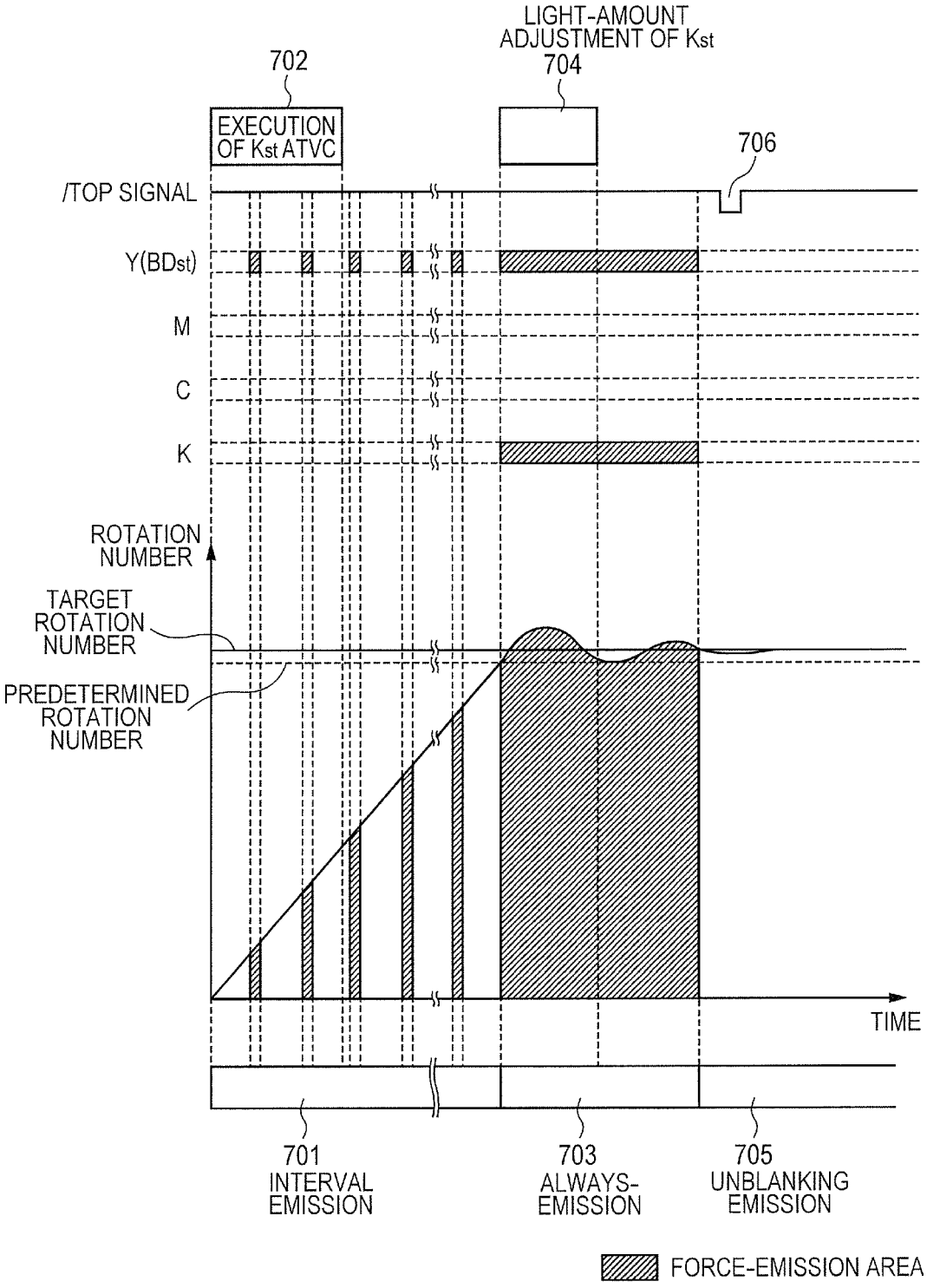
FIG. 6 is a chart showing scanner start-up and laser emission timings in the monochrome mode according to the first embodiment.

FIG. 6 is a view showing scanner start-up and laser emission timings in a monochrome mode of this embodiment, and a description about the same parameters as in FIG. 3 will not be repeated. The CPU 211 sets a target rotation number of the scanner motor 108 in the ASIC 212, and starts rotation driving of the scanner motor 108 via the ASIC 212. Also, the CPU 211 controls the semiconductor laser 107*a* of the BD station Y to repeat interval emissions at predetermined intervals via the ASIC 212 during the start-up control of the scanner motor 108 (zone 701). Note that the CPU 211 does not execute any light amount adjustment of the semiconductor laser 107*d* which is controlled to emit light in the image forming station K at an image forming timing. For this reason, the semiconductor laser 107*d* is turned off during the overall zone 701 in FIG. 6. On the other hand, the CPU 211 executes ATVC control in the image forming station K so as to determine a transfer voltage in the monochrome mode (zone 702). This point is different from the control of the comparative example of the zone 401 described using FIG. 3. Since the semiconductor laser 107*d* is turned off during the overall zone 701, the photosensitive drum 100*d* is not irradiated with any laser light, and the surface potential of the photosensitive drum 100*d* is not changed. For this reason, the ATVC control in the image forming station K can be executed during a zone 702 included in the zone 701.

After the ATVC control of the image forming station K is completed, and start-up of the scanner motor 108 is completed, the CPU 211 controls the semiconductor lasers 107*a* and 107*d* to make always-emission until the rotation number of the scanner motor 108 is stabilized (zone 703). Then, the CPU 211 executes the light amount adjustment of the semiconductor laser 107*d* during the always-emission zone 703 of the semiconductor laser 107*d* (zone 704). This point is different from the control of the comparative example of the zone 402 described using FIG. 3. Note that during the zone 703, the semiconductor laser 107*a* is controlled to make always-emission so as to monitor the rotation number of the scanner motor 108 by the BD sensor 110. When the CPU 211 judges based on the detection result of the BD sensor 110 that the rotation number of the scanner motor 108 has reached the target rotation number, it transitions to an unblanking emission zone in which laser light is irradiated only in the vicinity of the BD sensor 110 by the ASIC 212 (zone 705). Note that as described above using FIG. 3, the control of the comparative example executes the ATVC control during the zone 404 included in the zone 403. The CPU 211 permits the ASIC 212 to output a /TOP signal, thus starting image formation (timing 706).

As described above, in this embodiment, the ATVC control for the image forming station K ends during the zone 701, and the light amount adjustment of the semiconductor laser 107*d* ends during the zone 703. For this reason, the control of this embodiment shown in FIG. 6 outputs the /TOP signal at a timing earlier than that in the control of the comparative example shown in FIG. 3.

Control in Monochrome Mode of this Embodiment

Figure 7:
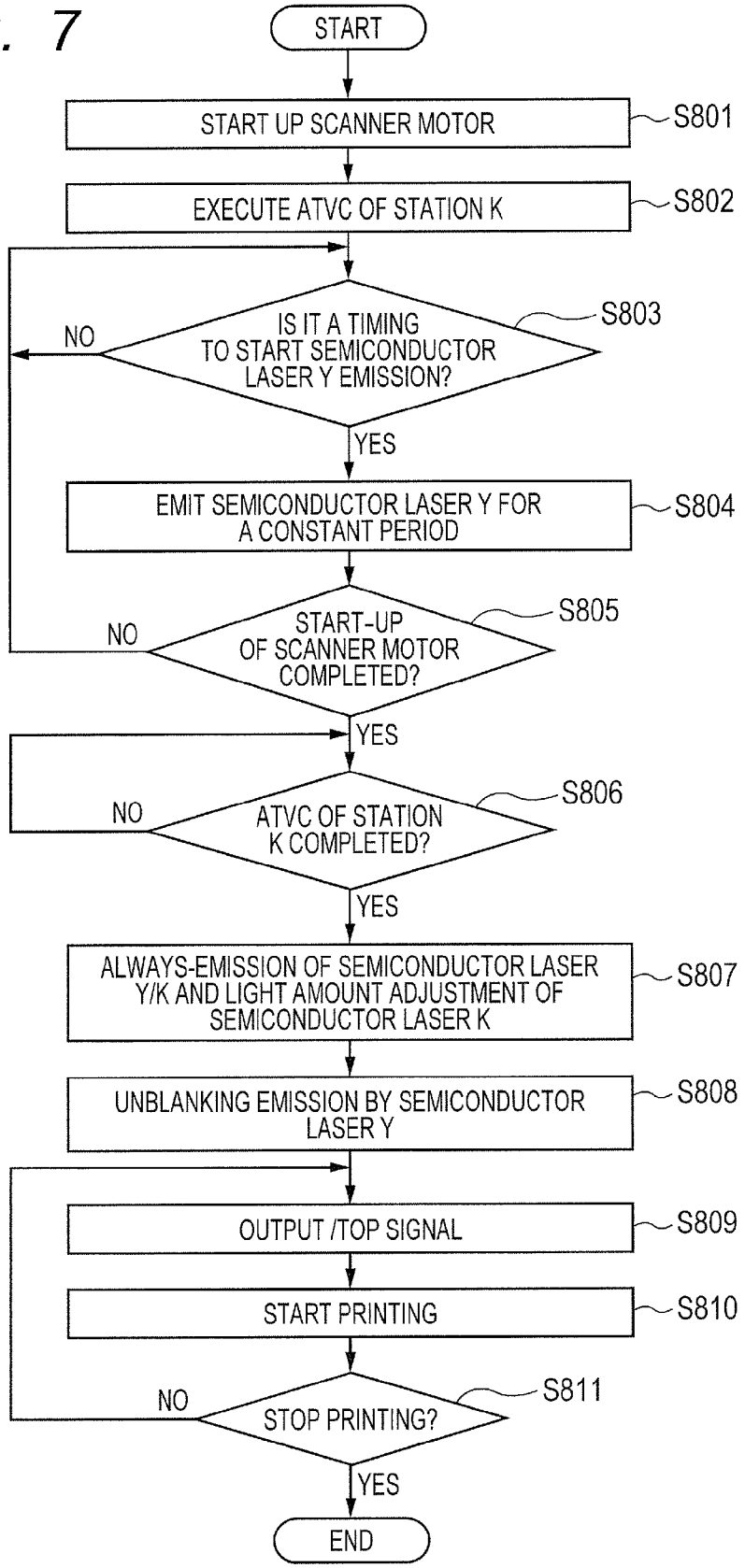
FIG. 7 is a flowchart for explaining scanner start-up in the monochrome mode according to the first embodiment.

FIG. 7 is a flowchart for explaining scanner start-up in the monochrome mode of this embodiment. In this embodiment, upon reception of a monochrome mode instruction from the controller 201, the CPU 211 controls the ASIC 212 to start to drive (start up) of the scanner motor 108 in S801, and executes the ATVC control of the image forming station K in S802. Note that the processes of S801 and S802 correspond to the zone 702 included in the interval emission zone 701 described using FIG. 6.

The CPU 211 judges in S803 whether or not an emission timing of the semiconductor laser 107*a* is reached. If the CPU 211 judges that the emission timing is not reached, the process returns to S803. If the CPU 211 judges in S803 that the emission timing of the semiconductor laser 107*a* is reached, it controls the semiconductor laser 107*a* to emit light for a constant period in S804. The CPU 211 judges in S805 whether or not start-up of the scanner motor 108 is completed. If the CPU 211 judges that start-up is not completed, the process returns to S803. Note that the processes of S801 to S805 correspond to the interval emission zone 701 described using FIG. 6.

If the CPU 211 judges in S805 that start-up of the scanner motor 108 is completed, it judges in S806 whether or not the ATVC control of the image forming station K is completed. If the CPU 211 judges in S806 that the ATVC control of the image forming station K is not completed, the process returns to S806. Note that FIG. 6 has explained the case in which a completed timing (the end of the zone 702) of the ATVC control of the image forming station K is earlier than that (the end of the zone 701) of start-up of the scanner motor 108. However, even when the completed timing of the ATVC control is later than that of start-up of the scanner motor 108, the OFF state of the semiconductor laser 107*d* is maintained until the ATVC control is completed by the processes of S805 and S806. Note that the same applies to the second embodiment to be described later.

If the CPU 211 judges in S806 that the ATVC control of the image forming station K is completed, it controls the semiconductor lasers 107*a* and 107*d* to make always-emission in S807, thus starting light amount adjustment of the semiconductor laser 107*d*. Note that the process of S806 corresponds to the zone 702 included in the interval emission zone 701 in FIG. 6. The process of S807 corresponds to the always-emission zone 703 and the zone 704 included in the zone 703 in FIG. 6. In S808, after the rotation number of the scanner motor 108 is stabilized, the CPU 211 controls the semiconductor laser 107*a* to make unblanking emission via the ASIC 212, and continues to monitor the rotation number of the scanner motor 108. The CPU 211 outputs a /TOP signal to the controller 201 in S809, and starts a printing operation in S810. As described above, in this embodiment, the unblanking emission can be started in S808, and the /TOP signal can be output in S809. This point is different from the control of the comparative example in which after the unblanking emission is started in S506 of FIG. 4, the ATVC control is completed in S507, and the /TOP signal is then output in S508. Note that the process of S808 corresponds to the zone 705 in FIG. 6, and that of S809 corresponds to the timing 706. The CPU 211 judges in S811 whether or not the printing operation ends. If the CPU 211 judges that the printing operation does not end, the process returns to S809. If the CPU 211 judges in S811 that the printing operation ends, it ends the overall processing.

As described above, the ATVC control of the image forming station K can be executed at the start-up timing of the scanner motor 108. For this reason, in this embodiment, the /TOP signal is output to start image formation immediately after the semiconductor laser starts unblanking emission. Thus, this embodiment can shorten the FPOT (first print-out time). Note that this embodiment has explained the case in which the image forming station Y is the BD station. However, the same applies to a case in which the monochrome mode is executed when the image forming station M or C is a BD station.

Second Embodiment

The second embodiment relates to control when a BD station is a black image forming station K in a color printing mode. This embodiment executes ATVC control of the image forming station without waiting until a scanner motor 108 is stably rotated at a target speed. Note that since the arrangement of an image forming apparatus of this embodiment is the same as the first embodiment except for the arrangement of a scanner unit 156 and the number of transfer current detection circuits 111 to be arranged (to be described later), the same reference numerals denote the same components, and a description thereof will not be repeated.

Arrangement of Scanner Unit

Figure 8:
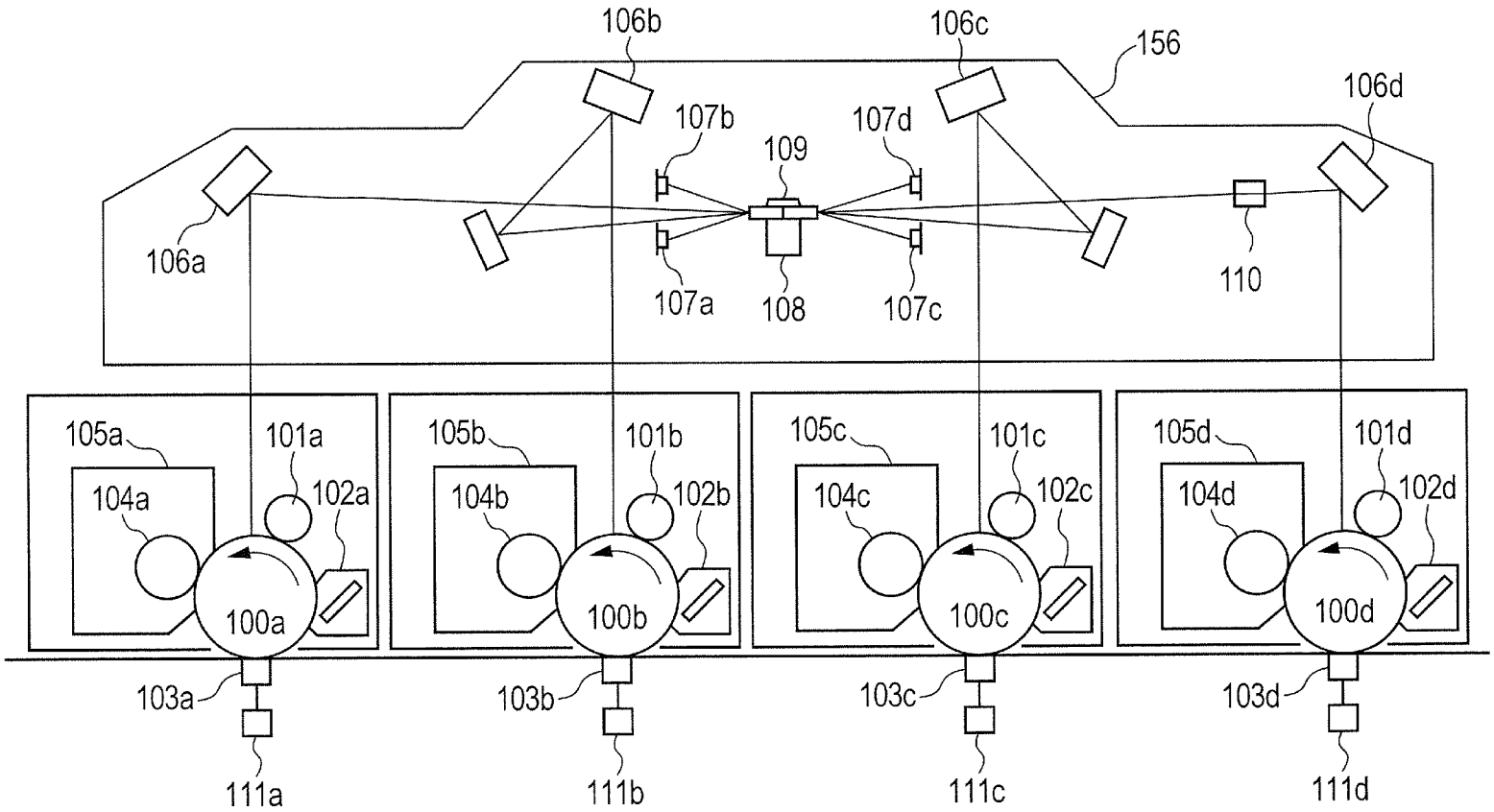
FIG. 8 is a schematic view showing the arrangement of a scanner unit according to the second embodiment.

FIG. 8 is a schematic view showing the arrangement of the scanner unit 156 of the second embodiment. In the scanner unit 156 of this embodiment, a BD sensor 110 is included in the black image forming station K. Note that the BD sensor 110 is used to detect laser light reflected by a rotary polygon mirror 109 driven by a scanner motor 108, as described in the first embodiment. In the second embodiment, transfer current detection circuits 111*a*, 111*b*, 111*c*, and 111*d* are respectively arranged for primary transfer units 103*a*, 103*b*, 103*c*, and 103*d*. The transfer current detection circuits 111*a*, 111*b*, 111*c*, and 111*d* respectively measure current values according to voltages applied to the primary transfer units 103*a*, 103*b*, 103*c*, and 103*d*.

Control of this Embodiment

Figure 9:
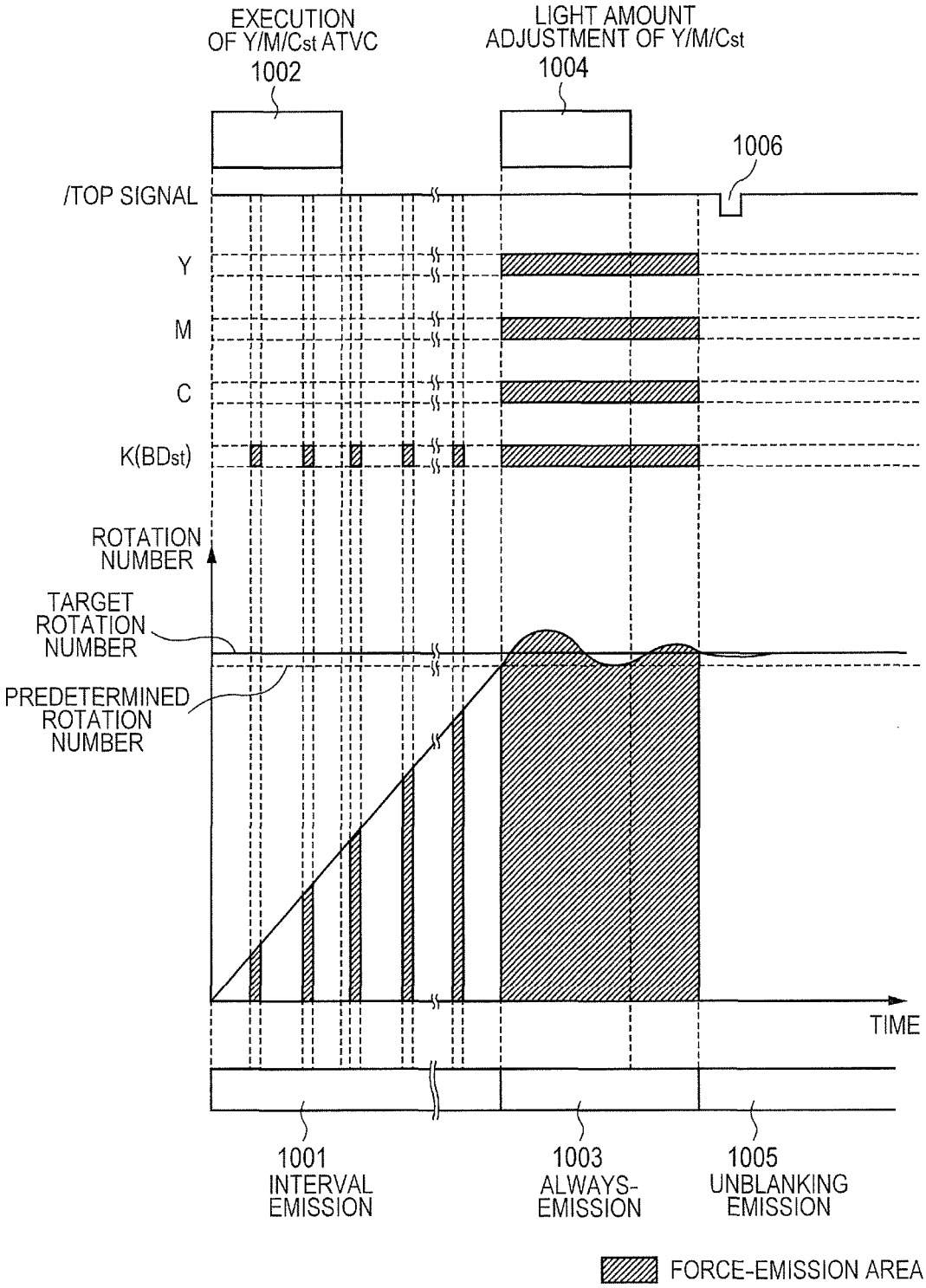
FIG. 9 is a chart showing scanner start-up and laser emission timings in a color mode according to the second embodiment.

FIG. 9 is a chart showing scanner start-up and laser emission timings of this embodiment in the color printing mode, and a description about the same parameters as those in FIG. 3 will not be repeated. A CPU 211 sets a target rotation number of the scanner motor 108 in an ASIC 212, and controls the ASIC 212 to start to drive the scanner motor 108. Also, the CPU 211 controls a semiconductor laser 107*d* of the image forming station K as a BD station (to be referred to as a BD station K hereinafter) repeat interval emissions at predetermined intervals via the ASIC 212 during the start-up control of the scanner motor 108 (zone 1001). Thus, the CPU 211 controls the rotation number of the scanner motor 108 to reach a target rotation number.

On the other hand, the CPU 211 does not execute light amount adjustment of semiconductor lasers 107*a*, 107*b*, and 107*c* in association with image forming stations Y, M, and C (described as "Y/M/Cst" in FIG. 9) during the zone 1001. The CPU 211 executes ATVC control for the image forming stations Y, M, and C during the zone 1001 so as to determine transfer voltages in the color mode (zone 1002).

After the ATVC control of the image forming stations Y, M, and C is completed, and start-up of the scanner motor 108 is completed, the CPU 211 executes the following processing. That is, the CPU 211 controls the semiconductor lasers 107*a*, 107*b*, 107*c*, and 107*d* to make always-emission until the rotation number of the scanner motor 108 is stabilized (zone 1003). The CPU 211 executes the light amount adjustment of the semiconductor lasers 107*a*, 107*b*, and 107*c* during a zone 1004 included in the always-emission zone 1003. Note that the semiconductor laser 107*d* is controlled to make always-emission so as to monitor the rotation number of the scanner motor 108 by the BD sensor 110 during the zone 1003. When the CPU 211 judges that the rotation number of the scanner motor 108 has reached the target rotation number, it controls the ASIC 212 to transition to an unblanking emission zone (zone 1005). In this embodiment, since the BD sensor 110 is included in the image forming station K, the semiconductor laser 107*d* makes unblanking emission. The CPU 211 permits the ASIC 212 to output a /TOP signal, and the /TOP signal is output to a controller 201, thus starting image formation (timing 1006). Note that in the color printing mode of this embodiment, black is formed by mixing three color toners Y, M, and C.

Control in Color Printing Mode of this Embodiment

Figure 10:
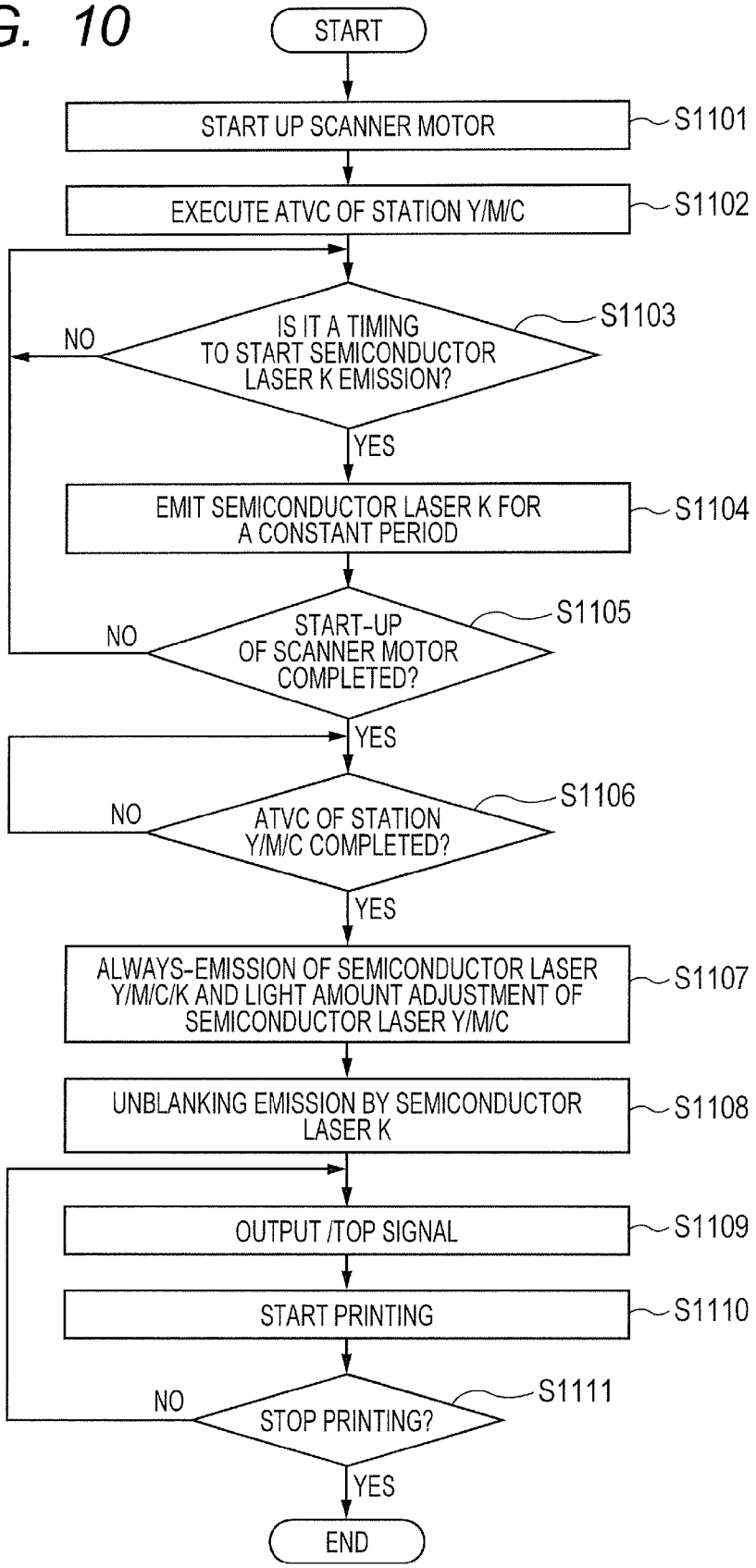
FIG. 10 is a flowchart for explaining scanner start-up in the color mode according to the second embodiment.

FIG. 10 is a flowchart for explaining scanner start-up in the color printing mode of this embodiment. Upon reception of a color printing instruction from the controller 201, the CPU 211 starts to drive (start up) the scanner motor 108 in S1101, and executes the ATVC control of the image forming stations Y, M, and C in S1102. Note that the process of S1102 corresponds to the zone 1002 described using FIG. 9.

The CPU 211 judges in S1103 whether or not an emission timing of the semiconductor laser 107*d* is reached. If the CPU 211 judges that the emission timing is not reached, the process returns to S1103. If the CPU 211 judges in S1103 that the emission timing of the semiconductor laser 107*d* is reached, it controls the semiconductor laser 107*d* to emit light for a certain period in S1104. The CPU 211 judges in S1105 whether or not start-up of the scanner motor 108 is completed. If the CPU 211 judges that start-up is not completed, the process returns to S1103. Note that the processes of S1101 to S1105 correspond to the interval emission zone 1001 of the semiconductor laser 107*d* described using FIG. 9. The CPU 211 controls so that the rotation number of the scanner motor 108 reaches the target rotation number by detecting laser light of the semiconductor laser 107*d* using the BD sensor 110 in the zone 1001.

If the CPU 211 judges in S1105 that start-up of the scanner motor 108 is completed, it judges in S1106 whether or not the ATVC control of the image forming stations Y, M, and C is completed. If the CPU 211 judges in S1106 that the ATVC control of the image forming stations Y, M, and C is not completed, the process returns to S1106. If the CPU 211 judges in S1106 that the ATVC control of the image forming stations Y, M, and C is completed, it controls the semiconductor lasers 107*a*, 107*b*, 107*c*, and 107*d* to make always-emission via the ASIC 212 in S1107. Then, the CPU 211 starts light amount adjustment of the semiconductor lasers 107*a*, 107*b*, and 107*c*. Also, the CPU 211 monitors the rotation number of the scanner motor 108 by detecting laser light emitted from the semiconductor laser 107*d* by the BD sensor 110. Note that the process of S1106 corresponds to the zone 1002 included in the interval emission zone 1001 shown in FIG. 9. Also, the process of S1107 corresponds to the always-emission zone 1003 in FIG. 9, and the zone 1004 included in the zone 1003.

After the rotation number of the scanner motor 108 is stabilized, the CPU 211 controls the semiconductor laser 107*d* to make unblanking emission via the ASIC 212 in S1108. Note the processes after S1008 and subsequent steps correspond to the unblanking emission zone 1005 described using FIG. 9. Since the processes of S1109 to S1111 are the same as those of S809 to S811 in FIG. 7 described in the first embodiment, a description thereof will not be repeated.

As described above, according to this embodiment, when the image forming station K is the BD station, and a color printing instruction is input, the following arrangement is adopted. That is, the arrangement in which the ATVC control of the image forming stations Y, M, and C is executed without waiting until the scanner motor 108 is stably rotated at a target speed is adopted. Therefore, the /TOP signal is output to the controller 201 to start image formation immediately after the unblanking emission of the scanner, thus shortening the FPOT. As described above, according to this embodiment, the first print-out time can be shortened.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-272402, filed Dec. 13, 2012, which is hereby incorporated by reference herein in its entirety.

What is claimed is:

1. An image forming apparatus comprising:

a first image bearing member and a second image bearing member, on each of which an electrostatic latent image is formed by laser light;

a first developing device and a second developing device, each configured to develop the electrostatic latent image formed on the corresponding image bearing member to form a toner image;

a first transfer device and a second transfer device, each configured to transfer the toner image on the corresponding image bearing member onto a recording medium;

a voltage applying unit configured to apply a voltage to the second transfer device;

a current detection unit configured to detect a current flowing when the voltage applying unit applies the voltage to the second transfer device;

a first light source and a second light source, each configured to emit laser light to the corresponding image bearing member;

a rotary polygon mirror configured to deflect the laser light beams emitted from the first light source and the second light source;

a motor configured to drive the rotary polygon mirror;

a detection unit configured to detect the laser light deflected by the rotary polygon mirror; and a control unit configured to execute start-up control for controlling driving of the motor based on a detection result of the detection unit so that a rotation number of the motor reaches a predetermined rotation number, and to execute determination control for determining a voltage to be applied from the voltage applying unit to the second transfer device upon execution of image formation, wherein the detection unit is arranged at a position where the detection unit detects the laser light deflected by the rotary polygon mirror toward the first image bearing member, and wherein the control unit executes the start-up control and the determination control in parallel.

2. The apparatus according to claim 1, wherein the control unit controls the second light source not to emit laser light during the determination control.

3. The apparatus according to claim 1, wherein the control unit controls the second light source to emit laser light to adjust a light amount of the laser light from the second light source after the determination control and the start-up control are completed.

4. The apparatus according to claim 3, wherein the control unit executes emission control for controlling the first light source to emit laser light only in a vicinity of the detection unit after the light-amount adjustment is completed.

5. The apparatus according to claim 4, wherein after the emission control for controlling the first light source to emit laser light only in the vicinity of the detection unit, an image forming operation is started.

6. The apparatus according to claim 1, wherein the start-up control executed by the control unit controls the first light source to make interval emissions until the rotation number of the motor reaches the predetermined rotation number.

7. The apparatus according to claim 1, wherein the determination control executed by the control unit changes a voltage applied by the voltage applying unit so that a current value detected by the current detection unit becomes a target current value, and determines a voltage upon detection of the target current value as a reference voltage.

8. The apparatus according to claim 7, wherein during an image formation, the control unit controls a voltage to be applied to the second transfer device by constant voltage control based on the reference voltage.

9. The apparatus according to claim 7, wherein during an image formation, the control unit controls a voltage to be applied to the second transfer device by constant current control based on the reference voltage.

10. The apparatus according to claim 1, wherein an electrostatic latent image is formed on the second image bearing member by the second light source so that a black toner image is developed by the second developing device, and the second transfer device transfers the black toner image from the second image bearing member onto the recording medium.

11. The apparatus according to claim 10, wherein the control unit is configured to execute a monochrome mode for transferring a toner image from only the second image bearing member onto the recording medium, and the control unit executes the start-up control and the determination control in parallel only in a case where the control unit executes the monochrome mode.

12. The apparatus according to claim 11, wherein an electrostatic latent image is formed on the first image bearing member by the first light source, and a color toner image is developed by the first developing device.

13. The apparatus according to claim 1, wherein an electrostatic latent image is formed on the second image bearing member by the second light source, and a color toner image is developed by the second developing device, and an electrostatic latent image is formed on the first image bearing member by the first light source, and a black toner image is developed by the first developing device.

14. The apparatus according to claim 13, wherein the control unit is configured to execute a color mode for transferring a toner image from only the second image bearing member onto the recording medium, and the control unit executes the start-up control and the determination control in parallel only in the case where the control unit executes the color mode.

15. The apparatus according to claim 1, wherein the recording medium includes an intermediate transfer belt.

* * * * *